US011841162B2

(12) United States Patent
Naber

(10) Patent No.: US 11,841,162 B2
(45) Date of Patent: Dec. 12, 2023

(54) PIPE BEND FOR AN EXHAUST AIR DUCT OF A FUME EXTRACTION HOOD

(71) Applicant: Naber Holding GmbH & Co., Nordhorn (DE)

(72) Inventor: Hans-Joachim Naber, Nordhorn (DE)

(73) Assignee: Naber Holding GmbH & Co.

( * ) Notice: Subject to any disclaimer, the term of this patent is extended or adjusted under 35 U.S.C. 154(b) by 0 days.

(21) Appl. No.: 17/749,301

(22) Filed: May 20, 2022

(65) Prior Publication Data

US 2022/0373218 A1 Nov. 24, 2022

(30) Foreign Application Priority Data

May 21, 2021 (DE) ..... 10 2021 113 249.5

(51) Int. Cl.
*F24F 13/08* (2006.01)
*F24F 13/02* (2006.01)

(52) U.S. Cl.
CPC ..... *F24F 13/081* (2013.01); *F24F 13/02* (2013.01)

(58) Field of Classification Search
CPC ..... F24F 13/081; F24F 13/02
USPC ..... 138/140
See application file for complete search history.

(56) References Cited

U.S. PATENT DOCUMENTS 2,216,046 A * 9/1940 Peck ..... F24F 13/081 285/179
2,590,797 A * 3/1952 Siciliano ..... F16L 43/003 285/183
4,919,170 A * 4/1990 Kallinich ..... F15D 1/04 428/410
5,054,819 A * 10/1991 Grunwald ..... F16L 43/001 285/133.11
6,290,266 B1 * 9/2001 Kawano ..... F16L 43/001 285/125.1
2004/0065375 A1 4/2004 Snider
2017/0273425 A1 9/2017 Stephens et al.
2017/0306994 A1 10/2017 Schmidt et al.
2019/0316805 A1 10/2019 Bruckbauer et al.
2022/0282889 A1 * 9/2022 Galkin ..... F24F 13/10

FOREIGN PATENT DOCUMENTS

DE 588113 C 11/1933
DE 10343892 A1 4/2004
DE 102016220527 A1 4/2018
(Continued)

*Primary Examiner* — Craig M Schneider
*Assistant Examiner* — David R Deal
(74) *Attorney, Agent, or Firm* — Harness, Dickey & Pierce, P.L.C.

(57) ABSTRACT

A pipe bend, in particular for an exhaust air duct of a fume extraction hood, which has a deflection of 60° to 120°, preferably 90°, with an inflow side and an outflow side, wherein the pipe bend has at least one air guide element which is curved in deflection direction and which extends in the interior of the pipe bend, characterized in that the pipe bend has a cross-sectional widening in flow direction behind the inflow side, in particular adjacent thereto, and a cross-sectional tapering in front of the outflow side, in particular adjacent thereto, the course of the bend of the outer wall of the bend deviating from the course of a quarter circle and having a bulge lying outside the vertex of the bend, in particular downstream of the vertex in the direction of flow.

22 Claims, 5 Drawing Sheets

(56) References Cited

FOREIGN PATENT DOCUMENTS

| | | | |
|---|---|---|---|
| EP | 1788259 | A1 | 5/2007 |
| EP | 2281138 | A1 | 2/2011 |
| FR | 1107453 | A | 1/1956 |

* cited by examiner

PIPE BEND FOR AN EXHAUST AIR DUCT OF A FUME EXTRACTION HOOD

CROSS-REFERENCE TO RELATED APPLICATIONS

This application claims the benefit and priority of German Application No. 10 2021 113 249.5 filed May 21, 2021. The entire disclosure of the above application is incorporated herein by reference.

BACKGROUND OF THE INVENTION

Technical Field

The invention relates to a pipe bend, in particular for an exhaust air duct of a fume extraction hood, which has a deflection of 60° to 120°, preferably 90°, with an inflow side and an outflow side, wherein the pipe bend has at least one air guide element which is curved in the deflection direction and extends in the interior of the pipe bend. Such a pipe bend is known, for example, from DE 10 2016 220 527 A1.

Discussion

In the case of generic pipe bends for exhaust air ducts of fume extraction hoods and the like, it is basically desirable to keep the pressure loss in the duct as low as possible. As is known, the pressure loss to be expected in the area of changes in direction of the duct, i.e. in particular in the area of the pipe bends, is particularly large because, due to the deflection of the air flow in the pipe bend, an at least partially non-laminar air flow occurs due to very turbulent air detachments and associated turbulences in the pipe bend. The air detachments and turbulences lead not only to a pressure loss but also to noise generation, which is fundamentally undesirable and should be reduced to as low a level as possible. A first approach to counter these problems is the use of air guide elements, although there is still a desire to further improve the achievable effects in terms of noise development and pressure loss reduction.

SUMMARY OF THE INVENTION

It is therefore an aspect of the invention to further develop a pipe bend of the type described above in such a way that it causes as little noise as possible and also has as low a pressure loss as possible for fluids flowing through it, in particular air and vapors.

Accordingly, it is provided that the pipe bend has a cross-sectional widening downstream of the inflow side, in particular adjacent thereto, and a cross-sectional tapering upstream of the outflow side, in particular adjacent thereto, the course of the bend of the pipe bend outer wall deviating from the course of a quarter circle and having a bulge lying outside the vertex of the pipe bend, in particular downstream of the vertex in the direction of flow.

To optimize the air flow, it can be advantageous to define one side of the pipe bend as the inflow side and the other side as the outflow side, since flow optimization requires an asymmetrical design of the pipe bend. It can also be provided that, in order to minimize the pressure loss, the pipe bend has a larger cross-section than the connection cross-sections in order to expand the flow cross-section in the area of the air guide elements. The cross-section expansion provided for this purpose can be directly adjacent to the inlet-side connection cross-section. The connection areas can be in the form of connection sleeves. The cross-section expansion can extend over a short distance, in particular outside the deflection area of the pipe bend. The widening of the flow cross section advantageously causes a reduction in wall friction losses and thus a reduction in the pressure loss in the flow. Furthermore, the widening causes a reduction of the flow velocity in the bend and thus a reduction of the inertial forces in the flow. The cross-sectional tapering provided may connect immediately upstream of the outflow-side connection cross-section in the direction of flow. The cross-sectional tapering can extend over a short distance, in particular outside the deflection area of the pipe bend.

The purpose of the bulge is to allow the volume flow to follow a bionic course. The outer wall of the pipe bend, which deviates from a quarter circle for this purpose, ensures an initially constant distance between the outermost air guide element in the outer region of the pipe bend, with the distance increasing behind the vertex of the pipe bend. This is particularly advantageous in interaction with a multi-part outer air guide element. As a result, the flow approaches a bionic course, which improves the flow pattern of the pipe bend. The bionic course of the wall contour is based on the meandering of a riverbed to achieve low pressure differences across the cross section. The non-circular contour prevents locally high flow velocities.

It may be provided that the radius of the pipe bend inner wall corresponds to the course of a quarter circle. This means that the pipe bend can have an ordinary pipe bend inner wall in the form of a quarter circle compared to the bionic pipe bend outer wall.

It can be provided that the cross-sectional area of the pipe bend over the entire course of the bend is larger than the inflow cross-section and the outflow cross-section of the pipe bend. This advantageously ensures that there is no undesirable pressure loss at any point of the pipe bend. In designs that provide for a change in cross-section between the inflow side and the outflow side, such as from a flat duct to a round duct, it can be provided that the cross-sectional area of both different cross-sectional shapes remains essentially the same, with the intermediate pipe bend section having a larger cross-sectional area throughout.

It may be provided that the at least one air guide element has a concave end edge on the face side on the inflow side of the pipe bend. This concave guide body shape on the inlet side of the air guide elements ensures optimum flow guidance on the inlet side. The concave curvature can be realized in that the center of the terminating edge projects further into the pipe bend, or is retracted into it, compared with the terminating edge edges abutting the inner sides of the wall. This forces the flow away from the wall to reduce wall friction.

It may be provided that the end edge of the at least one air guide element on the inflow side of the pipe bend projects into the inflow cross section in the region of the opposite wall areas. For this purpose, the outer regions of the terminating edge can project into the connecting sleeve in a jagged manner. In this way, the flow is detected at an early stage before being deflected in the bend. Furthermore, the leading edges of the guide bodies can be optimized for tangential inflow to avoid shock losses.

It can be provided that the at least one air guide element has a convex end edge on the outflow side of the pipe bend. This convex guide body shape on the outflow side of the air guide elements ensures optimum flow guidance on the outflow side. The convex curvature can be realized by the center of the end edge projecting further into the connection sleeve compared with the end edge edges abutting the inner sides of the wall.

It may be provided that a central region of the end-face terminal edge of the at least one air guide element projects into the outflow cross-section on the outflow side of the pipe bend. The trailing edges of the guide element may thus be extended towards the center of the duct to achieve complete flow redirection before entering the straight air duct.

It can be provided that the at least one air guide element has a comb-like or sawtooth-shaped serrated end edge at the end face on an outflow side of the pipe bend. It has been found that a particularly low-noise flow can be realized by the serrated end edge. The serrations can, for example, be of sharp-edged design or of wave-shaped design. It is also conceivable for the outflow end edge to be both convex in shape and serrated in a comb-like manner.

It may be provided that the at least one air conducting element has on its surface at least one trip edge or tripwire arranged perpendicularly and/or parallel to the direction of flow. Furthermore, a plurality of tripwires arranged perpendicularly to the flow direction one behind the other or a plurality of tripwires arranged parallel to the flow direction one beside the other may be arranged on the air guiding element surface. Furthermore, it is conceivable that the trip edges are arranged in a grid-like manner on the air guiding element surface. The trip edges can be arranged on one of the air guiding element sides or on both sides. In particular, it is conceivable that the trip edges are arranged on the suction sides of the guide bodies in order to bring about a turbulent boundary layer to prevent flow separation and to achieve loss-free deflection. In particular, it may be provided that in the case of the guide bodies with smaller radii, i.e. the inner guide bodies, a trip edge is arranged in the front region as viewed in the direction of flow. In particular, provision can also be made for the guide bodies with larger radii, i.e. the outer guide bodies, to have a trip edge arranged in the rear area as seen in the direction of flow.

It may be provided that the air directing element is multi-part, wherein a first and a second part element of the air directing element are offset from each other in a radial direction of the pipe bend.

The curved air guide elements can be made of two parts in particular. Alternatively, however, they can also be formed in three parts or from even more parts. For example, the air guide elements can be formed from a plurality of air guide element sub-elements, the sub-elements each being straight and each having an offset from the adjacent air guide element, the sub-elements thus arranged in the pipe bend defining an arc. In this case, the adjacent partial elements can each be rotated relative to one another by a corresponding number of angular degrees. In the two-part design, the air guide elements are preferably divided halfway along their length in the direction of extension between the opposing connection cross sections of the pipe bend, for example at a vertex of the air guide element.

In one embodiment, the partial elements can overlap with each other in an overlap area of ends of the partial elements that face each other. In this case, it can be provided that the two-part elements are just spaced in front of each other by an offset in the overlap area. In the overlap area, they can preferably extend in parallel.

In an alternative embodiment, the part elements can be aligned with their end faces facing each other. Preferably, they do not have to be exactly opposite each other. Rather, it can merely be provided that the end faces of the part elements are aligned in the radial direction of their curvature.

When the pipe bend has a plurality of curved air guide members, it may be provided that a first curved air guide member has overlapping part members of the type described above in an overlap area, while a second curved air guide member has part members facing each other with their end faces aligned in the radial direction of curvature. For example, the curved air guide member with the overlapping partial members may be an outer curved air guide member, while the curved air guide member with the end faces aligned is an inner curved air guide member which is disposed closer to an inner radius of the pipe bend compared to the outer curved air guide member, thus having a smaller radius of curvature than the outer air guide member.

If the air guiding element is designed in two parts, it can be provided in particular that the first and the second part element have the offset to each other at a vertex of the air guiding element.

It has been found that the spacing of the partial elements in the radial direction of the curvature of the air guide element leads to a reduction in flow separation and thus to a suppression of the formation of turbulence in the pipe bend, which ultimately reduces the pressure loss and noise development of the pipe bend compared to pipe bends known from the prior art.

It may be provided that the pipe bend has a plurality of air guide elements arranged substantially parallel next to one another in the pipe bend, the air guide element nearest to the outer wall of the pipe bend being multi-part in the sense of claim 10. The design of the outer air guide element with at least two partial elements ensures a reduction in flow separation, particularly in the edge region of the pipe bend which is susceptible to boundary layer separation.

Depending on the diameter of the pipe bend, it may be advantageous to adjust the number of air guide elements arranged next to each other accordingly and to provide a larger number of air guide elements for larger diameters and vice versa.

It may be provided that the pipe bend has three air guide elements arranged parallel to one another in the pipe bend, the middle and inner air guide elements each being of one-piece design.

It may be provided that the distances between the air guide elements increase towards the outer wall of the pipe bend, the average distance between the outer air guide element and the central air guide element being 1.4-1.8 times, preferably 1.5-1.7 times, particularly preferably 1.6 times, greater than the distance between the central air guide element and the inner air guide element.

It may be provided that the distance of the inner air guide element to the inner wall of the pipe bend is a maximum of 20%, preferably a maximum of 15%, particularly preferably a maximum of 9% of the mean pipe bend radius. It has been found that, in particular, bringing the inner guide element closer to the inner radius of the pipe bend leads to a considerable improvement in the flow behavior.

It may be provided that the pipe bend has spaced guide grooves on opposite inner sides for lateral insertion and fixing of the air guide elements in the pipe bend. A separate pair of opposing and aligned guide grooves can be provided in the pipe bend for each air guide element or for each sub-element. The guide grooves can be designed in such a way that the air guide elements can only be inserted into them after overcoming a pretension. The assembly of the air guide elements can depend on the method of joining the half-shells. In the case of mirror welding, for example, the air guide elements can be pre-centered on one side in a half-shell by means of an injection-molded guide on the air guide element due to the automatic process and the mirror thickness and then thermally joined later.

It can be provided that the pipe bend has an installation indicator, in particular in the form of an arrow, to indicate the installation direction on the outside of the pipe bend. On the one hand, this simplifies and speeds up installation and, on the other hand, makes it particularly easy to identify the direction of flow after installation of the elbow.

The mounting indicator may be formed as a depression in the material of the elbow or as an accumulation of material. The mounting indicator may be located on one side, the top or bottom, or a combination thereof of the elbow.

In the area of the inflow side and/or the outflow side, the pipe bend can have connection points on both sides and, in particular, in the center for d a connecting element via which the pipe bend can be connected to adjacent pipe elements.

It may be provided that the pipe bend is designed as a flat duct bend or as a transition bend from a rectangular flat duct connection to a round duct connection, or vice versa.

It may be provided that the surface of the air guide element facing the inner wall of the pipe bend is doubly curved, with a first curvature extending at least in sections along the direction of flow and with a second curvature extending at least in sections perpendicular to the direction of flow. The curvatures may optionally both be concave. Alternatively, a first curvature may be concave in the direction of flow corresponding to the curvature of the pipe bend and a second curvature may be convex perpendicular to the direction of flow towards the inner wall of the pipe bend, so that the air guide element or elements represent hyperbolic paraboloids.

BRIEF DESCRIPTION OF THE DRAWINGS

Further features, advantages and characteristics of the invention can be seen in the following description of preferred embodiments of the invention with reference to the accompanying drawings, in which show.

DESCRIPTION OF THE PREFERRED EMBODIMENTS

Figure 1:
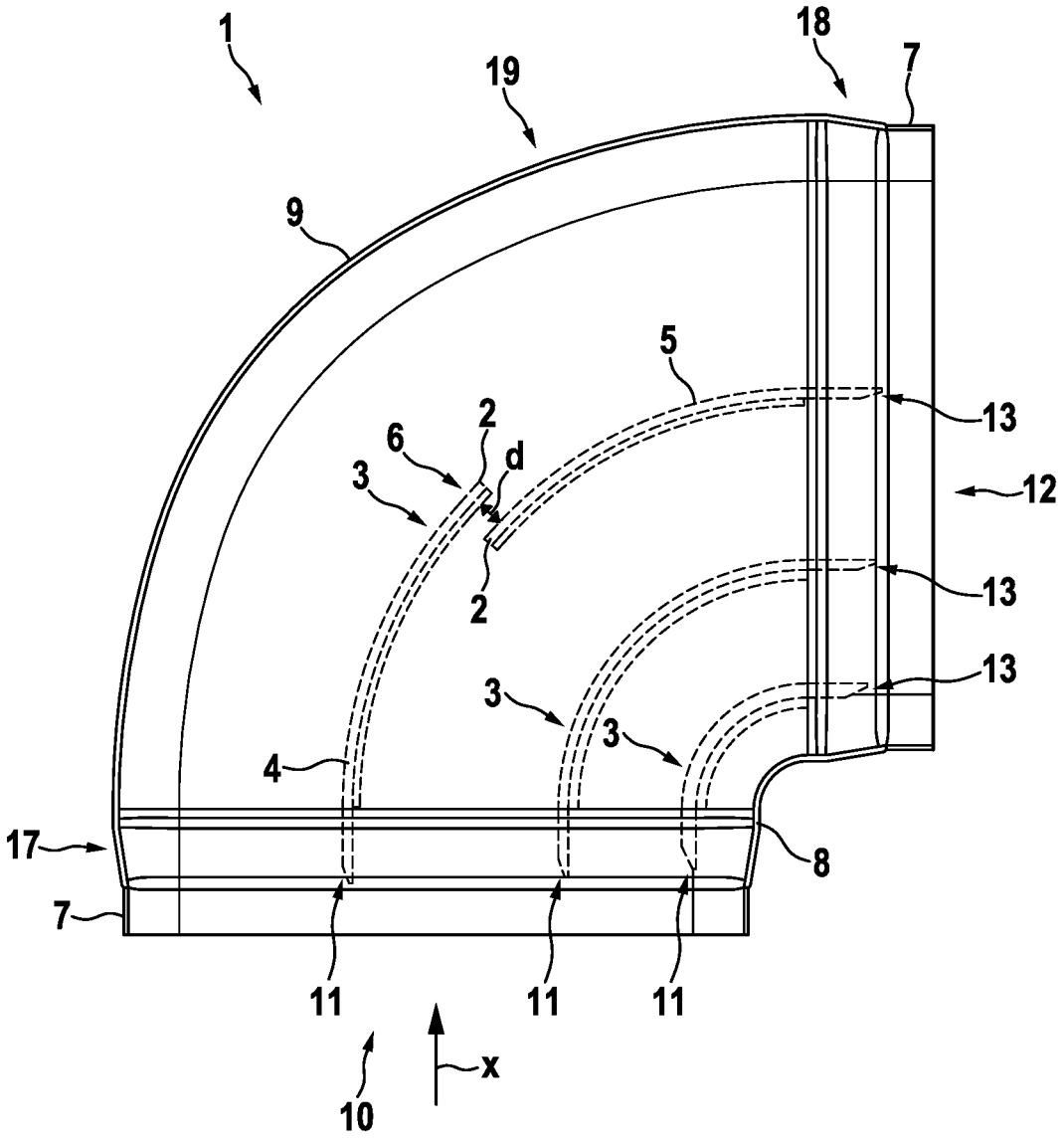
FIG. 1 is a top view of an embodiment of the pipe bend according to the invention.

FIG. 1 shows a first embodiment of a pipe bend 1 according to the invention in the form of a flat duct which deflects the air to be discharged from an extraction hood by 90°. The pipe bend 1 has an inflow side 10 and an outflow side 12, by which the flow direction x is defined. As a result, when the elbow is installed, care must be taken to ensure that it is inserted in the correct orientation so that the exhaust air flows in through the inflow side 10 and out through the outflow side 12. Three air guide elements 3 are arranged in the pipe bend 1, with the air guide element 3 closest to the outer wall 9 of the pipe bend consisting of two partial elements 4 and 5, which overlap in an overlap area 6 with opposite ends 2 and have an offset d from each other. The rear sub-element 5 in the direction of flow x is arranged closer in the direction of the inner pipe bend wall 8 compared with the front sub-element 4. In the overlap area 6, the partial element sections 4, 5 run equidistantly to each other. Furthermore, the partial elements 4, 5 each run equidistantly to the adjacent middle air guide element 3, which in turn runs equidistantly to the innermost air guide element 3. The air guide elements 3 and the partial elements 4, 5 each have a double concave curvature. A first curvature follows the course of the pipe bend 1 and a second concave curvature is characterized by a curvature of the elements around their extension in the flow direction x, so that they are each concave towards the inner wall 8 of the pipe bend. In particular, it can be seen that the inner air guide element 3 has a greater second concave curvature than the middle one, and the middle one has a greater second concave curvature than each of the partial elements 4, 5 of the outer air guide element 3. Accordingly, the inner air guide element 3 projects further toward the outer wall 9 of the pipe bend than the middle and outer ones, and correspondingly the middle one projects further than the outer air guide element 3. These different degrees of curvature result in an optimum deflection of the air at each point of the pipe bend, taking into account the different sharp radii of curvature at which the different air deflection elements 3 are positioned. In the region between the vertex of the pipe bend 1 and the outflow side 12, the pipe bend outer wall has a bulge 19 directed towards the outside of the pipe bend 1. This can be one-dimensional, for example, so that a constant bulge 19 is realized over the course of the height of the pipe bend 1. Alternatively, it can be provided that the bulge 19 is bubble-shaped, so that its largest elevation is provided in or approximately in the height course in the center of the pipe bend 1, and in contrast the areas of the pipe bend outer wall 9 adjacent to the inner walls 15 have no elevation or a smaller elevation in comparison. In the direction of flow x, the bulge 19 can have an initially flat rise, compared with the course of a quarter circle, up to a vertex of the bulge 19. Behind the vertex of the bulge 19, it can then have a steeper drop to the level of the quarter circle compared to the rise. On the inflow side 10 as well as on the outflow side 12, the pipe bend 1 in the embodiment shown has connection sleeves with the same connection cross-section 7. It can be seen that all air guide elements 3 extend approximately up to the connection sleeves. On the inflow side, a cross-sectional widening 17 is provided behind the connection sleeve, and in front of the outflow side 12, a cross-sectional tapering 18 adjoins the connection sleeve on the outflow side. In the area between the connection sleeves, the pipe bend 1 thus has no point at which its cross section is smaller than or equal to the connection sleeve cross section 7. Furthermore, it can be seen that the distances of the air guide elements 3 from the inner pipe bend wall 8 to the outer pipe bend wall 9 increase. The inner air guide element 3 is arranged very close to the pipe bend inner wall, approximately at one tenth of the pipe bend width. The outer air guide element 3, on the other hand, is arranged far away from the pipe bend outer wall 9 and in the range ½ to ⅔ of the pipe bend width.

Figure 2:
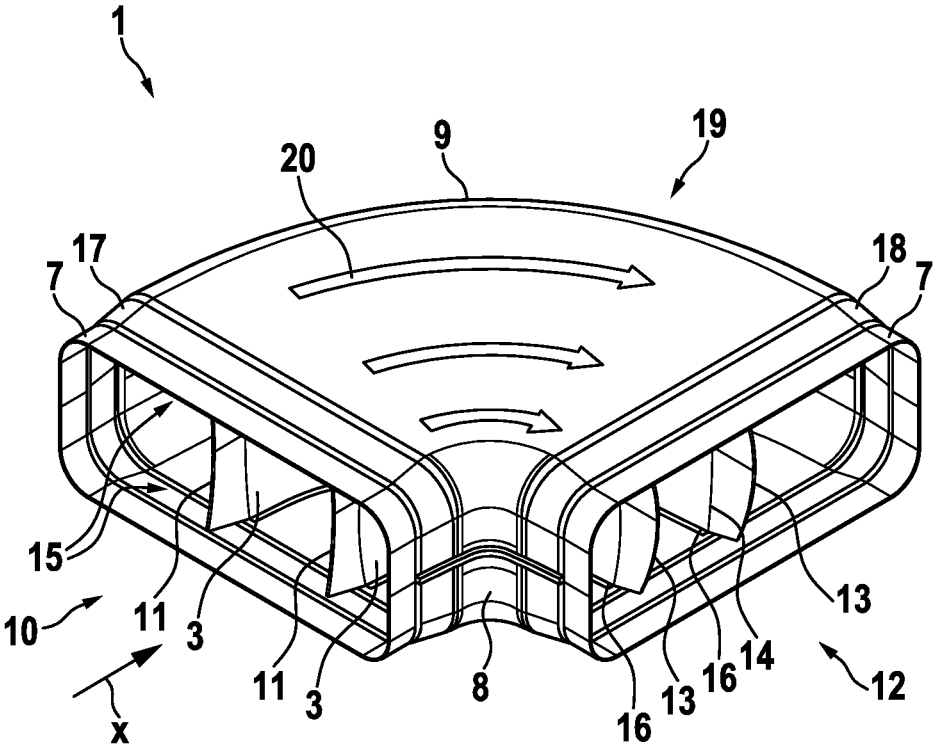
FIG. 2 is a perspective view of an embodiment of the pipe bend according to the invention.

FIG. 2 shows a further embodiment of the pipe bend 1, which also has connecting sleeves with identical connecting cross sections 7 on the inlet and outlet sides, with a cross-sectional widening 17 adjoining the inlet side 10 and a cross-sectional tapering 18 being arranged immediately upstream of the outlet side 12. A number of assembly indicators 20 are arranged on the upper side of the pipe bend 1, which are realized in the form of arrows. On the one hand, these indicate to an installer the installation direction of the pipe bend 1 and, on the other hand, the flow direction x of the pipe bend 1 after installation. The installation indicator can be realized by material recesses as shown, or alternatively by material thickenings. Furthermore, it is conceivable that this is highlighted in color on the outside of the pipe bend 1. In particular, it can be seen in the perspective shown that the air guide elements 3 have concave end edges 11 on the inflow side, so that the average height of the air guide elements 3 projects into the pipe bend 1 in the direction of flow x with respect to the outer edges located on the inner sides 15 of the pipe bend. On the outflow side, on the other hand, the terminating edges 13 of the air guide elements 3 are convex in shape, so that the average height of the air guide elements 3 projects out of the pipe bend 1 in the direction of flow x with respect to the outer edges lying on the inner sides 15 of the pipe bend. The air guide element 3 closest to the inner wall 8 of the pipe bend cannot be seen in the perspective shown, but likewise has terminating edges 11, 13 which are concave on one side and convex on the other. The air guide elements 3 are each fixed in the pipe bend by guide grooves 16. It is not shown that the guide grooves 16 associated with an air guide element 3 are formed on both opposing inner sides 15 of the pipe bend 1 and are aligned with one another. The air guide elements 3 can either be inserted into them laterally or inserted vertically into them before the half-shells of the pipe bend 1 are assembled. The air guide elements further have trip edges 14, or tripwires, which in the embodiment shown are arranged in a grid-like manner on the air guide elements 3 and help to improve the air flow in the pipe bend 1. The tripwires can be step-like material thickenings which are formed on the air guide elements 3.

Figure 3:
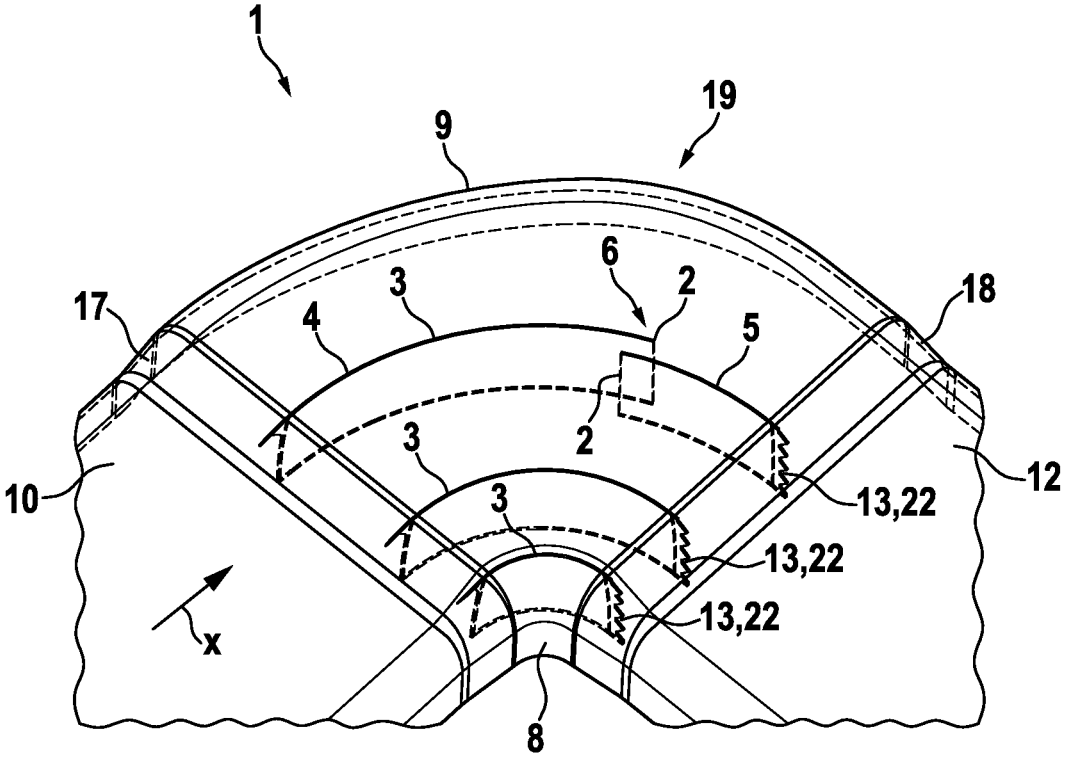
FIG. 3 is a perspective view of a further embodiment of the pipe bend according to the invention.

FIG. 3 shows a further embodiment of the pipe bend 1 in the already installed state. This also has, in particular, the bulge 19 and three equidistantly extending air guide elements 3, of which the one closest to the outer wall 9 of the pipe bend is divided into two sub-elements 4, 5. In particular, it can be seen that the outflow-side terminating edges 13 of the air guide elements 3 have comb-like serrated ends 22, which are modeled on the course of owl wings and ensure the quietest possible air guidance by reducing sound even at different flow velocities.

Figure 4:
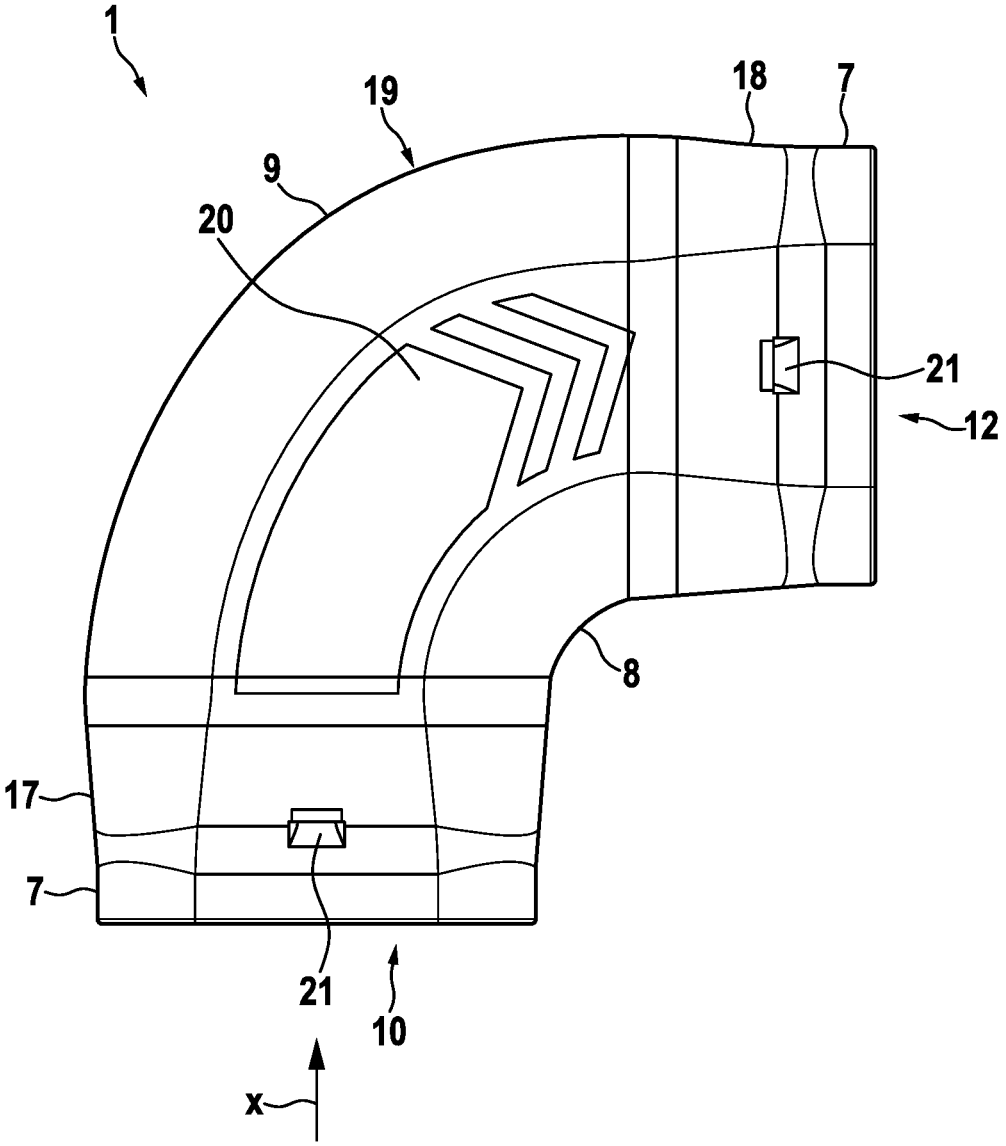
FIG. 4 is a top view of a further embodiment of the pipe bend according to the invention.

FIG. 4 shows a further embodiment of the pipe bend 1 according to the invention. This has, in particular, connection points 21 in the form of undercut locking elements which are arranged on the inflow side and outflow side on the outer sides, top and bottom, of the pipe bend 1 and via which connection elements can be connected to the pipe bend 1. In the embodiment shown, the assembly indicator 20 is realized by a wide arrow at the tip of which further arrows are connected at intervals in the direction of flow.

Figure 5:
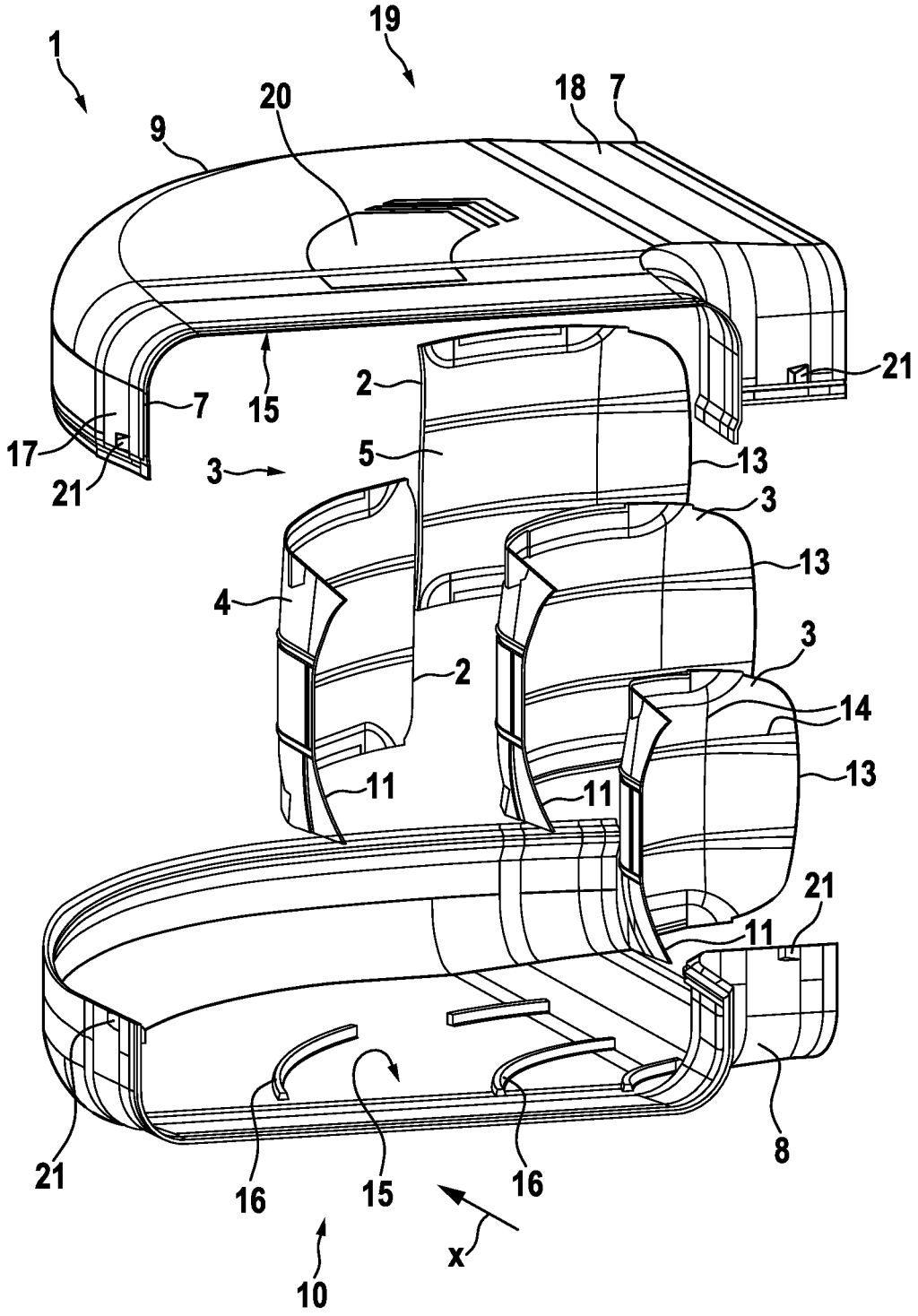
FIG. 5 is an exploded view of a further embodiment of the pipe bend according to the invention.

Finally, FIG. 5 shows an embodiment of the elbow 1 in exploded view. This has a lower shell and an upper shell which can be detachably connected to one another via snap-in connections arranged at the contact points. The shells separate the pipe bend 1 parallel to the deflection plane. The air guide elements 3 or their sub-elements 4, 5 are accommodated between the shells and can be fixed in guide grooves 16 on the inner sides 15 of the upper shell and the lower shell of the pipe bend 1. In contrast to the embodiment in FIG. 4, the connection points 21 are now arranged on the sides of the pipe bend 1.

The features of the invention disclosed in the foregoing description, in the drawings as well as in the claims may be essential to the realization of the invention both individually and in any combination.

What is claimed is:

1. A pipe bend an exhaust air duct of a fume extraction hood comprising: the pipe bend having a deflection of 60° to 120° with an inflow side and an outflow side, wherein the pipe bend has at least one air guide element which is curved in deflection direction and which extends in the interior of the pipe bend, wherein the pipe bend has in flow direction behind the inflow side, a cross-sectional widening and in front of the outflow side, and a cross-sectional tapering, wherein the course of the bend of the outer wall of the pipe bend deviates from the course of a quarter circle and has a bulge lying outside the vertex of the pipe bend downstream of the vertex in the direction of flow and wherein the at least one air guide element has a concave terminating edge at the end face on the inflow side of the pipe bend.

2. The pipe bend according to claim 1, wherein the radius of the pipe bend inner wall corresponds to the shape of a quarter circle.

3. The pipe bend according to claim 1, the cross-sectional area of which over the entire course of the bend is larger than the inflow cross-section and the outflow cross-section of the pipe bend.

4. The pipe bend according to claim 1, in which the concave terminating edge of the at least one air guide element on the inflow side of the pipe bend projects into the inflow cross section in the region of the opposite wall regions.

5. The pipe bend according to claim 1, in which a central region of the end-face terminating edge of the at least one air guide element on the outflow side of the pipe bend projects into the outflow cross section.

6. The pipe bend according to claim 1, in which the at least one air guide element has a comb-like serrated end on the end face on an outflow side of the pipe bend.

7. The pipe bend according to claim 1, in which the at least one air guide element has on its surface at least one trip edge arranged perpendicularly or parallel to the flow direction.

8. The pipe bend according to claim 1, which comprises a plurality of air guide elements arranged substantially parallel side by side in the pipe bend, wherein the air guide element closest to the pipe bend outer wall is multi-part.

9. The pipe bend according to claim 8, which has three air guide elements arranged parallel next to one another in the pipe bend, the middle and the inner air guide element each being of one-piece design.

10. The pipe bend according to claim 9, wherein the distances of the air guide elements increase towards the pipe bend outer wall, wherein the average distance of the outer air guide element to the middle air guide element is greater by 1.4-1.8 times than the distance of the middle air guide element to the inner air guide element.

11. The pipe bend according to claim 8, wherein the distance of the inner air guide element from the inner pipe bend wall is at most 20% of the mean pipe bend radius.

12. The pipe bend according to claim 1, which has spaced guide grooves on opposite inner sides for lateral insertion and fixation of the air guide elements in the pipe bend.

13. The pipe bend according to claim 1, which has an installation indicator, in particular in the form of an arrow, for indicating the installation direction on the outside of the pipe bend.

14. The pipe bend according to claim 1, which is formed as a flat duct bend or as a transition bend from a rectangular flat duct connection to a round duct connection, or vice versa.

15. A pipe bend an exhaust air duct of a fume extraction hood comprising: the pipe bend having a deflection of 60° to 120° with an inflow side and an outflow side, wherein the pipe bend has at least one air guide element which is curved in deflection direction and which extends in the interior of the pipe bend, wherein the pipe bend has in flow direction behind the inflow side, a cross-sectional widening and in front of the outflow side, a cross-sectional tapering, wherein the course of the bend of the outer wall of the pipe bend deviates from the course of a quarter circle and has a bulge lying outside the vertex of the pipe bend, downstream of the vertex in the direction of flow: and wherein the at least one air guide element has a convex terminating edge on the end face on the outflow side of the pipe bend.

16. The pipe bend according to claim 15 wherein the radius of the pipe bend inner wall corresponds to the shape of a quarter circle.

17. The pipe bend according to claim 15 where in the cross-sectional area over the entire course of the pipe bend is larger than the inflow cross-section and the outflow cross-section of the pipe bend.

18. The pipe bend according to claim 15 wherein the pipe bend is formed as a flat duct bend or as a transition bend from a rectangular flat duct connection to a round duct connection, or vice versa.

19. A pipe bend an exhaust air duct of a fume extraction hood comprising: the pipe bend having a deflection of 60° to 120° with an inflow side and an outflow side, wherein the pipe bend has at least one air guide element which is curved in deflection direction and which extends in the interior of the pipe bend, wherein the pipe bend has in flow direction behind the inflow side, a cross-sectional widening and in front of the outflow side, a cross-sectional tapering, wherein the course of the bend of the outer wall of the pipe bend deviates from the course of a quarter circle and has a bulge lying outside the vertex of the pipe bend, downstream of the vertex in the direction of flow: and wherein the at least one air guiding element is multi-part, and wherein a first and a second part of the multi-part air guiding element have an offset (d) with respect to each other in a radial direction of the pipe bend.

20. The pipe bend according to claim 19 wherein the radius of the pipe bend inner wall corresponds to the shape of a quarter circle.

21. The pipe bend according to claim 19 where in the cross-sectional area over the entire course of the pipe bend is larger than the inflow cross-section and the outflow cross-section of the pipe bend.

22. The pipe bend according to claim 19 wherein the pipe bend is formed as a flat duct bend or as a transition bend from a rectangular flat duct connection to a round duct connection, or vice versa.

* * * * *